US009543131B2

(12) United States Patent
Kuehn et al.

(10) Patent No.: US 9,543,131 B2
(45) Date of Patent: Jan. 10, 2017

(54) METHOD OF OPERATING A MASS FILTER IN MASS SPECTROMETRY

(71) Applicant: Thermo Fisher Scientific (Bremen) GmbH, Bremen (DE)

(72) Inventors: Andreas Kuehn, Bremen (DE); Jan-Peter Hauschild, Weyhe (DE); Dirk Nolting, Bremen (DE); Oliver Lange, Bremen (DE); Eugen Damoc, Stuhr (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 14/180,194

(22) Filed: Feb. 13, 2014

(65) Prior Publication Data

US 2014/0224975 A1 Aug. 14, 2014

(30) Foreign Application Priority Data

Feb. 14, 2013 (GB) ..... 1302558.0

(51) Int. Cl.
*H01J 49/02* (2006.01)
*H01J 49/42* (2006.01)
(Continued)

(52) U.S. Cl.
CPC ..... *H01J 49/0031* (2013.01); *H01J 49/022* (2013.01); *H01J 49/06* (2013.01); *H01J 49/4215* (2013.01)

(58) Field of Classification Search
CPC .... H01J 49/00; H01J 49/0027; H01J 49/0031; H01J 49/0036; H01J 49/02; H01J 49/26; H01J 49/282
(Continued)

(56) References Cited

U.S. PATENT DOCUMENTS 6,331,702 B1 * 12/2001 Krutchinsky ..... H01J 49/04 250/281
6,504,148 B1 * 1/2003 Hager ..... 250/282
(Continued)

FOREIGN PATENT DOCUMENTS

DE 10322020 A1 12/2003
DE 60120337 T2 5/2007
(Continued)

OTHER PUBLICATIONS

Olsen et al, "Higher-Energy C-trap Dissociation for Peptide Modification Analysis", Nature Methods 4, 709-712, 2007.*

*Primary Examiner* — David E Smith
(74) *Attorney, Agent, or Firm* — Nicholas Cairns; Timothy J. Ohara

(57) ABSTRACT

Disclosed herein is a mass spectrometry method having steps of: transmitting ions from an ion source through a mass filter; processing ions received from the mass filter in a discontinuous ion optical device downstream of the mass filter; operating the mass filter for a plurality of periods in a mass/charge ratio (m/z) filtering mode to transmit ions in one or more selected ranges of m/z to the discontinuous ion optical device; and operating the mass filter in a broad mass range mode transmitting ions of a mass range substantially wider than any mass range transmitted in the m/z filtering mode during one or more periods in which the discontinuous ion optical device is not processing ions from the mass filter. Utilization of this method assists to reduce contamination in the mass filter.

17 Claims, 1 Drawing Sheet

(51) Int. Cl.
*H01J 49/00* (2006.01)
*H01J 49/06* (2006.01)

(58) Field of Classification Search
USPC ..... 250/281, 282, 290, 294
See application file for complete search history.

(56) References Cited

U.S. PATENT DOCUMENTS

| | | | | |
|---|---|---|---|---|
| 2002/0014586 | A1* | 2/2002 | Clemmer | 250/287 |
| 2004/0098719 | A1* | 5/2004 | Smith | G06F 9/466 718/101 |
| 2004/0222369 | A1* | 11/2004 | Makarov et al. | 250/281 |
| 2005/0098719 | A1* | 5/2005 | Thomson | H01J 49/0081 250/288 |
| 2008/0017789 | A1* | 1/2008 | Hager | H01J 49/004 250/283 |
| 2009/0090853 | A1* | 4/2009 | Schoen et al. | 250/282 |
| 2011/0057098 | A1* | 3/2011 | Le Blanc | H01J 49/4295 250/283 |

FOREIGN PATENT DOCUMENTS

| | | | |
|---|---|---|---|
| DE | 10397000 | B4 | 8/2014 |
| GB | 2421843 | A | 7/2006 |
| GB | 2490958 | A * | 11/2012 |

* cited by examiner

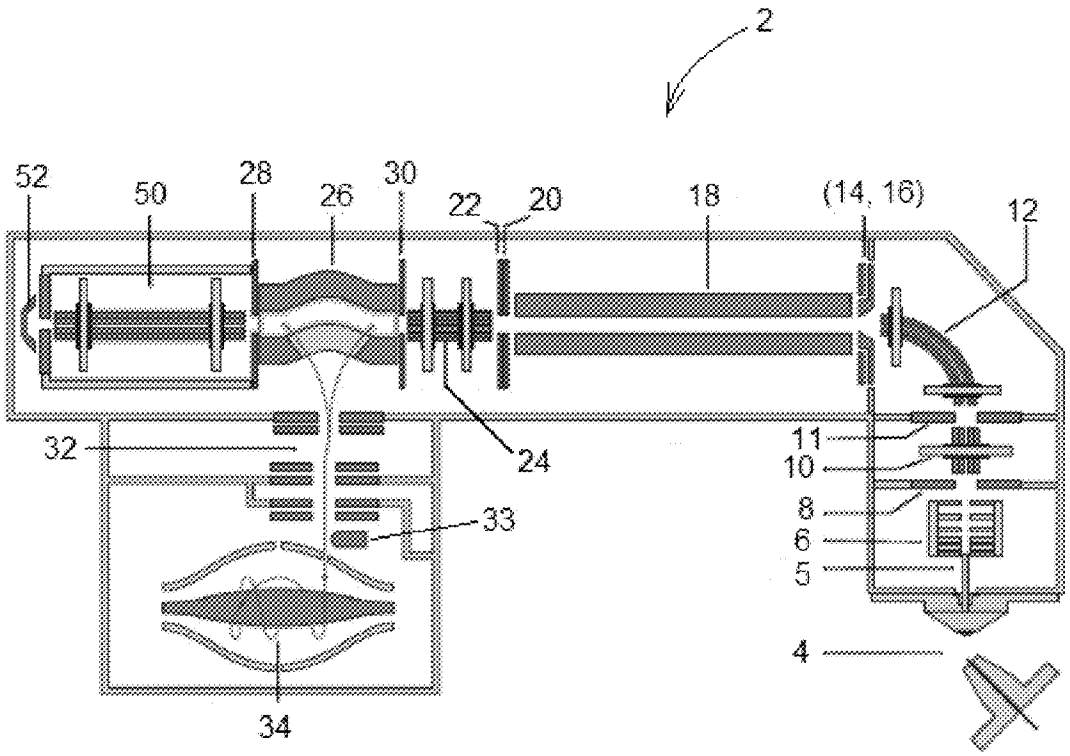
2
52
50
28
26
30
22
20
18
(14, 16)
12
32
33
24
34
11
10
8
6
5
4

METHOD OF OPERATING A MASS FILTER IN MASS SPECTROMETRY

CROSS REFERENCE TO RELATED APPLICATIONS

This application claims the priority benefit under 35 U.S.C. §119 to a Great Britain Patent Application No. 1302558.0, filed on Feb. 14, 2013, entitled "Method of operating a mass filter in mass spectrometry," the disclosure of which is incorporated herein by reference.

FIELD OF THE INVENTION

This invention generally relates to mass spectrometry using mass filters, particularly, but not exclusively, quadrupole mass filters. It relates to reducing contamination in said mass filters.

BACKGROUND OF THE INVENTION

As is well known, mass filters (e.g. quadrupoles with round rods or hyperbolic rods) are used in many mass spectrometers to separate one ion species from another. In a quadrupole mass filter, opposing rod pairs are connected together. For selecting ions with one or more mass/charge (m/z) ratios of interest, an RF voltage, superimposed by a DC voltage, is applied between the two rod pairs. That is, the rods of the first opposing rod pair are connected together such that the rods have the same phase as each other, while the rods of the second opposing rod pair are connected together such that the rods have the same phase as each other but opposite to the phase on the first rod pair.

The m/z ratios of interest can be selected by adjusting the combination of DC voltage and RF voltage amplitude to appropriate values. A selected m/z range of interest is stable within the quadrupole and will be transmitted through it. All other ions will be unstable and many will hit one or more of the quadrupole rods. Some ions hitting a surface of the rods can stick to that surface. The tendency for a striking ion to stick to the surface may depend on its sample class (molecular structure), its incident angle, its kinetic energy, the surface temperature, the surface roughness, and the surface material amongst other factors. Ions that stick to the surface can thereby modify the work function of the material of the surface and can form insulating layers which are prone to charging effects.

In most applications, cleaning of the rods is hardly needed and indeed cleaning typically is not required at all or only required at intervals of years. That is typically the case for small molecule applications for example. However, under the conditions of some extreme applications, in certain proteomics cases for example, employing a narrow isolation range of precursor ions and when whole proteome digests are analysed with very high loads on nano-LC columns, a charging effect may be visible after several months and in the very worst case after several days of full time operation. This charging effect will lower the overall transmission of the device and lead to a general sensitivity loss for the experiment. In order to recover the sensitivity, the quadrupole mass filter must be physically cleaned, which results in instrument downtime and service costs.

SUMMARY OF THE INVENTION

Against the above background the present invention provides in one aspect a method of mass spectrometry comprising:

transmitting ions from an ion source through a mass filter;

providing a discontinuous ion optical device downstream of the mass filter for processing ions received from the mass filter;

operating the mass filter for a plurality of periods in a mass/charge ratio (m/z) filtering mode to transmit ions in one or more selected ranges of m/z to the discontinuous ion optical device; and operating the mass filter in a broad mass range mode transmitting ions of a mass range substantially wider than any mass range transmitted in the m/z filtering mode during one or more periods in which the discontinuous ion optical device is not processing ions from the mass filter.

In another aspect, the present invention provides a mass spectrometer comprising:

an ion source for producing ions;

a mass filter for transmitting ions from the ion source;

a discontinuous ion optical device downstream of the mass filter for processing ions received from the mass filter; and a controller arranged to operate the mass filter for a plurality of periods in a mass/charge ratio (m/z) filtering mode to transmit ions in one or more selected ranges of m/z to the discontinuous ion optical device and to operate the mass filter in a broad mass range mode transmitting ions of a mass range substantially wider than any mass range transmitted in the m/z filtering mode during one or more periods in which the discontinuous ion optical device is not processing ions from the mass filter.

Preferably, the broad mass range mode is a substantially non-m/z filtering mode.

In a further aspect, the present invention provides a computer program having program code enabling a controller (e.g. the controller of the spectrometer) to operate the mass filter according to the method of the invention. In the further aspect, the present invention preferably provides a computer program having program code enabling the controller (i.e. when the program is executed on a computer of the controller) to operate the mass filter for a plurality of periods in a mass/charge ratio (m/z) filtering mode to transmit ions in one or more selected ranges of m/z to the discontinuous ion optical device and to operate the mass filter in a broad mass range or substantially non-m/z filtering mode during one or more periods in which the discontinuous ion optical device is not processing ions from the mass filter. In a still further aspect, the present invention provides a computer readable medium carrying the computer program. The medium is readable by a computer such that the program can be executed on the computer.

Advantageously, the invention can reduce contamination in a mass filter, especially a multipole mass filter, by reducing ion deposition on the surfaces of the mass filter as described in more detail below. In the broad mass range or substantially non-m/z filtering mode, most ions are transmitted through the mass filter and thus do not strike surfaces of the mass filter, which could lead to contamination. In this case, since only a small portion of the ions might hit the rods (ions with m/z below a low mass cut off), the probability of a contamination layer building up and causing charging effects is very low. In contrast, conventionally, between periods of the discontinuous ion optical device processing ions received from the mass filter operating in a mass filtering mode, the mass filter is left in the last used mass filtering mode, or it is set up for the next mass filtering mode (next m/z isolation window), such that many ions are left to strike surfaces of the filter and contaminate them.

Preferably, the ions transmitted in one or more selected ranges of m/z to the discontinuous ion optical device by operating the mass filter for a plurality of periods in a m/z filtering mode are processed in the discontinuous ion optical device. The processing preferably comprises collecting ions and/or providing discontinuous transmission of ions. The invention then comprises operating the mass filter in a broad mass range or substantially non-m/z filtering mode during one or more periods when the discontinuous ion optical device is not processing ions from the mass filter. The one or more periods when the discontinuous ion optical device is not processing ions from the mass filter are preferably idle times between periods in which the discontinuous ion optical device is processing ions received from the mass filter. In a preferred type of embodiment, whereas the discontinuous ion optical device accepts ions from the mass filter when operating the mass filter in a m/z filtering mode, the discontinuous ion optical device does not accept ions when operating the mass filter in the broad mass range or substantially non-m/z filtering mode.

Operating the mass filter in a broad mass range or substantially non-m/z filtering mode is thus preferably performed between periods of the discontinuous ion optical device processing ions received from the mass filter operating in a mass filtering mode. In one type of embodiment, the method comprises switching the mass filter at least once between different m/z ranges (for selecting the m/z range of ion transmission to the discontinuous ion optical device), wherein, in order to reduce charging of one or more surfaces of the mass filter, the switching includes a time interval during which the mass filter is operating in a broad mass range or substantially non-filtering mode (such as substantially RF-only mode as described below). Thus, in the idle times between the periods when the discontinuous ion optical device is processing ions received from the mass filter, the mass filter is operated in the broad mass range or substantially non-filtering mode so as to reduce mass filter contamination and so lengthen the interval between cleaning operations. Preferably, in each such idle time (i.e. in substantially all such idle times), the mass filter is operated in the broad mass range or substantially non-filtering mode.

Thus, the method preferably comprises switching the mass filter a plurality of times between transmitting different m/z ranges wherein, in order to reduce charging of one or more surfaces of the mass filter, each switching includes a time interval during which the mass filter is operated in the broad mass range or substantially non-filtering mode.

Operating the mass filter in a broad mass range or substantially non-filtering mode is preferably performed for substantially all periods in which the discontinuous ion optical device is not processing ions (preferably not collecting ions or providing (discontinuous) transmission of ions) received from the mass filter. Thus, the mass filter is operated in the broad mass range or substantially non-filtering mode when ions are not being used by the discontinuous ion optical device. This may occur when the duration of the discontinuous ion optical device using the ions is less than the duration of an analysis of the ions downstream.

Preferably, the duration of the periods of operating in the broad mass range or substantially non-filtering mode on average exceed at least: a) 1%, or b) 5%, or c) 10%, or d) 20%, or d) 30%, or e) 40%, or f) 50% of the duration of the periods operating in the filtering mode. This average refers to a comparison of an average duration of the non-filtering mode periods and an average duration of the filtering mode periods. Further preferably, the duration of the periods of operating in the broad mass range or substantially non-filtering mode is at least 1%, or at least 10%, or at least 20%, or at least 30% (especially 1 to 40%) of the total analysis time (sum of the periods in both filtering and non-filtering modes).

The range of m/z selected in the m/z filtering mode may be a single m/z value or a range of m/z values. The m/z ranges selected in the plurality of periods of operating in a m/z filtering mode are independently selected, for example they may be the same range as each other or different ranges.

The mass filter is preferably a mass filter in which electrodes are provided with a combination of RF and DC voltages in the m/z filtering mode and are provided (supplied) with substantially only RF voltage in the substantially non-filtering mode. That is, the substantially non-filtering mode is preferably an RF-only mode. Under such conditions, most ions are stable within the mass filter and will be transmitted through it. In some embodiments, a small resolving DC voltage may be applied to the electrodes (in addition to the RF), for example where the DC/RF voltage ratio is 0.0 (i.e. pure RF only mode), or not greater than 0.001, or not greater than 0.01, or not greater than 0.025, or not greater than 0.05, or not greater than 0.06. Thus, substantially RF-only herein preferably means having a DC of zero or not exceeding the aforementioned values. The electrodes are preferably rods of a multipole mass filter. The mass filter thus may be a multipole mass filter. The multipole may be, for example, a quadrupole, a hexapole or an octapole. Preferably, the mass filter is a quadrupole, which may be a 3D or 2D (linear) quadrupole. The rods of the multipole (quadrupole) may be round rods or hyperbolic rods. In certain embodiments, the multipole may be a flatapole, wherein the rods are flat, i.e. have a flat surface.

The transmission of ions though the mass filter is preferably continuous. This means continuous or continuously, i.e. without interruption, at least for the duration of the experiment (the experiment consisting of the plurality of periods or scans with the mass filter in both filtering and non-filtering modes). This means the ions continue to flow through the mass filter even when it is not needed to process them (indeed when they are not processed) as described and it includes embodiments wherein ions are in a steady continuous stream, or a chopped beam, or in pulses. The transmission of ions is typically provided in the form of a continuous beam of ions from a continuous ion source, i.e. one that produces a continuous stream of ions for analysis. An example of such an ion source is an electrospray ionisation (ESI) source. The transmission of ions may be pulsed, e.g. a constant sequence of ion pulses. The ion source may be a pulsed source, such as e.g. MALDI, in configurations where pulses of ions continue to flow through the mass filter even when it is not needed to process them as described (e.g. to store them).

In some embodiments of the invention, another mass filter may be provided either upstream or downstream of the mass filter described, preferably upstream. The other mass filter may be of a same or similar type or of a different type to the mass filter described. Optionally, the method of the invention may be applied in respect of the other mass filter as well. Therefore, in such embodiments, there may be provided a method of mass spectrometry comprising:

transmitting ions from an ion source through a first mass filter and a second mass filter (in that order);

providing a discontinuous ion optical device downstream of the second mass filter for processing ions received from the second mass filter;

operating at least one of the mass filters for a plurality of periods in a mass/charge ratio (m/z) filtering mode to transmit ions in one or more selected ranges of m/z to the discontinuous ion optical device; and operating at least one of the mass filters in a broad mass range mode transmitting ions of a mass range substantially wider than any mass range transmitted in the m/z filtering mode during one or more periods in which the discontinuous ion optical device is not processing ions from the second mass filter.

Preferably, the method of the invention is applied to the second mass filter and optionally it is applied to the first mass filter.

Similarly, the mass spectrometer may be provided comprising:

an ion source for producing ions;

a first and a second mass filter for transmitting ions from the ion source;

a discontinuous ion optical device downstream of the second mass filter for processing ions received from the mass filter; and a controller arranged to operate at least one of the mass filters for a plurality of periods in a mass/charge ratio (m/z) filtering mode to transmit ions in one or more selected ranges of m/z to the discontinuous ion optical device and to operate at least one of the mass filters in a broad mass range mode transmitting ions of a mass range substantially wider than any mass range transmitted in the m/z filtering mode during one or more periods in which the discontinuous ion optical device is not processing ions from the mass filter.

The method comprises processing ions received from the mass filter in a discontinuous ion optical device downstream of the mass filter.

The discontinuous ion optical device is an ion optical device that discontinuously (i.e. not continuously but instead intermittently) processes ions. Typically, it processes ions in groups with a period in-between. The discontinuous ion optical device is preferably a pulsed ion optical device, i.e. which transmits or ejects ions in pulses (short packets). The ion optical device may be an ion trap, or ion deflector, or an orthogonal accelerator for example. The ion optical device is preferably an ion trap. The processing of the ions by the discontinuous ion optical device may comprises one or more of collecting the ions, transmitting the ions, deflecting the ions and accelerating the ions. The ion trap may act as a mass analyser. Accordingly, in some embodiments, the discontinuous ion optical device may be a mass analyser, e.g. an ion trap mass analyser, or a time of flight (TOF) mass analyser, or a Fourier Transform Ion Cyclotron Resonance (FT-ICR) mass analyser, or an electrostatic trapping (such as an electrostatic orbital trapping) mass analyser, or a multipole transmission mass analyser.

The discontinuous ion optical device downstream of the mass filter may be immediately downstream of the mass filter, or with one or more other ion optical devices between the mass filter and the discontinuous ion optical device, such as one or more lenses and/or ion guides and/or mass filters for example. The discontinuous ion optical device is typically for discontinuous transmission (preferably pulsed transmission) of ions further downstream, e.g. to a mass analyser as described below. The discontinuous ion optical device may provide a pulsed transmission of ions, for example to a mass analyser that requires a pulsed input of ions (i.e. a short packet of ions) such as a time of flight (TOF), Fourier Transform Ion Cyclotron Resonance (FT-ICR) or electrostatic trapping (such as an electrostatic orbital trapping) mass analyser. Thus, the method preferably comprises analysing ions processed by the discontinuous ion optical device in a mass analyser downstream of the discontinuous ion optical device. Preferably, when the duration of processing ions with the discontinuous ion optical device is less than the duration of analysing said ions in the mass analyser, especially (but not exclusively) where said analyser is a Fourier Transform mass analyser (FTMS), there will exist an idle time in which the discontinuous ion optical device is not processing or using ions and the mass filter should be operated in the non-filtering mode as described.

The discontinuous ion optical device may be, for example, an ion deflector, an orthogonal accelerator (oa), or an ion trap such as a 3D ion trap or a linear ion trap. It is preferably an ion trap and more preferably a linear ion trap. The linear ion trap may be a straight linear ion trap or preferably a curved linear ion trap (C-trap). Where the discontinuous ion optical device is an ion trap, the ion trap preferably collects (i.e. accumulates or stores) ions received from the mass filter and subsequently transmits the collected ions, for example as a pulse of ions, to a mass analyser (especially an FTMS mass analyser, such as an electrostatic orbital trap mass analyser). Most preferably, whenever the ion trap is not collecting ions (i.e. not processing ions), the mass filter is operated in the substantially non-filtering mode. Thus, the mass filter is operated in the broad mass range or substantially non-filtering mode (substantially RF-only mode) when the ions are not being used by the ion trap.

When the mass filter is being operated in the broad mass range or substantially non-filtering mode (e.g. during the above described idle times) in order to reduce charging of one or more surfaces of the mass filter, the ions may be prevented from entering the discontinuous ion optical device by an ion blocking device such as an ion lens and/or ion deflector positioned between the mass filter and the discontinuous ion optical device. Such a blocking device is preferably configured so that ions are not reflected by it upstream into the mass filter when it is blocking ion transmission to the discontinuous ion optical device. The blocking device is also configured such that blocked ions may strike a surface such that deposition of ions on that surface and/or charging of that surface do not influence the transmission of the ion beam. Preferably, this surface is downstream of the blocking device.

The discontinuous (e.g. pulsed) transmission of ions downstream from the discontinuous ion optical device is preferably to a mass analyser. The mass analyser is for producing a mass spectrum from the ions. The mass analyser may be, for example, a Fourier Transform mass spectrometry (FTMS) mass analyser, such as an FT-ICR or an electrostatic orbital trap mass analyser (such as an Orbitrap™ mass analyser) for instance, a TOF mass analyser (of any type), an ion trap mass analyser (of any type), a dynamically operating quadrupolar mass analyser/filter etc.

The controller of the spectrometer preferably comprises a computer.

The above features are further described below, along with other details of the invention.

DETAILED DESCRIPTION OF EMBODIMENTS

In order to assist further understanding of the invention, but without limiting the scope thereof, exemplary embodiments of the invention are now described with reference to FIG. 1, which shows a schematic layout of a mass spectrometer for performing the method of the invention.

Referring to FIG. 1, a mass spectrometer 2 is shown in which ions are generated from a sample in an atmospheric pressure ion (API) source 4, which may be a conventional ion source such as an electrospray. Ions are generated as a continuous stream in the ion source. The sample which is ionised in the ion source may come from an interfaced instrument such as a liquid chromatograph (not shown). The ions pass through a capillary 5, are transferred by an RF only S-lens 6, and pass the S-lens exit lens 8. The ions in the ion beam are next transmitted through an injection flatapole 10 (which optionally may carry a resolving DC voltage to act thereby as a first mass filter), an inter-flatapole lens 11 and a bent flatapole 12 (which optionally may provide an axial field) which are RF only devices to transmit the ions. The ions then pass through a pair of lenses 14 and 16 and enter a mass filter in the form of mass resolving quadrupole 18. The mass resolving quadrupole 18 will act thereby as a second mass filter in embodiments where the injection flatapole 10 is a first mass filter.

The RF and DC voltages of the quadrupole 18 are controlled to either transmit substantially most of the ions (termed RF only mode) or select ions of particular m/z for transmission by applying RF and DC according to the well known Mathieu stability diagram. In other embodiments, an alternative mass resolving device may be employed instead of quadrupole 18. In the shown embodiment, the ion beam which is transmitted through quadrupole 18 exits from the quadrupole through a quadrupole exit lens 20 and is switched on and off by a split lens 22. Then the ions are transferred through a transfer multipole 24 (RF only) and collected in a curved linear ion trap (C-trap) 26. The C-trap is a discontinuous ion optical device as described above. The C-trap is elongated in an axial direction (thereby defining a trap axis) in which the ions enter the trap. Voltage on the C-trap exit lens 28 can be set in such a way that ions cannot pass through it and thereby are trapped within the C-trap 26 using collisions with a bath gas. Similarly, after the desired ion fill time into the C-trap has been reached, the voltage on C-trap entrance lens 30 is set such that ions cannot pass out of the trap and ions are no longer injected into the C-trap. More accurate gating of the incoming ion beam is provided by the split lens 22. The ions are trapped radially in the C-trap by applying RF voltage to the curved rods of the trap in a known manner.

Ions which are stored within the C-trap 26 can be ejected orthogonally to the axis of the trap (orthogonal ejection) by pulsing DC to the C-trap in order for the ions to be injected as pulses, in this case via Z-lens 32 and deflector 33, into a mass analyser 34, which in this case is an electrostatic orbital trap, more specifically an Orbitrap™ mass analyser made by Thermo Fisher Scientific. The detected signal from the orbital trap 34 can be processed using Fourier transformation to obtain a mass spectrum. Alternatively to the orbital trap 34, another type of mass analyser could be used such as an FT-ICR or TOF mass analyser (e.g. linear TOF, or single-reflection or multi-reflection TOF). In the case of a TOF, the C-trap may be replaced by an orthogonal accelerator (oa) or another type of pulsed ion injector.

The mass spectrometer 2 further comprises a collision or reaction cell 50 downstream of the C-trap 26, e.g. for fragmentation and/or cooling of the ions. Ions collected in the C-trap 26 can be ejected orthogonally as a pulse to the mass analyser 34 without entering the collision or reaction cell 50 or the ions can be transmitted axially to the collision or reaction cell for processing before returning the processed ions to the C-trap for subsequent orthogonal ejection to the mass analyser. The C-trap exit lens 28 in that case is set to allow ions to enter the collision or reaction cell 50 and ions can be injected into the collision or reaction cell by an appropriate voltage gradient between the C-trap and the collision or reaction cell (e.g. the collision or reaction cell may be offset to negative potential for positive ions). The collision energy can be controlled by this voltage gradient. After processing in the collision or reaction cell 50 the potential of the cell 50 may be offset so as to eject ions back into the C-trap (the C-trap exit lens 28 being set to allow the return of the ions to the C-trap) for storage, for example the voltage offset of the cell 50 may be lifted to eject positive ions back to the C-trap. The ions thus stored in the C-trap may then be injected into the mass analyser 34 as described above. A collector or charge detector 52 may be used to determine the stored charges in the C-trap from time to time. In this mode, the ions are stored in the C-trap but are axially ejected through the HCD collision cell to the collector. The collector mode could optionally be operated during idle times.

The spectrometer may be operated in a full MS mode scan in which a full m/z range of ions are transmitted by the quadrupole mass filter 18 and collected in the C-trap 26 for ejection to and analysis in the analyser 34. The spectrometer may also be operated in mass selective modes (m/z filtering periods) in which the quadrupole mass filter 18 is set to isolate the ions with m/z of interest before they are collected in the C-trap and then analysed (optionally with fragmentation in the collision cell).

For slow discontinuous mass analysers, e.g. those with ion traps of any type, including the one shown in FIG. 1, the duty cycle is usually well below 100%. For instance, the quadrupole mass filter 18 is used to isolate the ions of interest (in m/z filtering mode) before they are filled into the C-trap 26. In the typical operation mode, the injection time into the C-trap is controlled in order to collect a specified (optimum) number of charges in the C-trap. These collected charges are analyzed by FTMS using the analyser 34, which takes a certain amount of time. At the end of the FTMS acquisition, the ions for the next scan are injected to the C-trap. Thus, the C-trap discontinuously processes the ions (since there is a time interval between successive fills of the C-trap). Now if the analysis acquisition time is longer than the injection (fill) time for the ions of the subsequent scan (certainly true for high abundant ion species), the ion beam is blocked by the split lens 22 for an injection idle time. That is, there is an injection idle time during which the ions are not collected or transmitted by the C-trap. According to prior art methods, during the injection idle time the quadrupole 18 stays configured in isolation (filtering) mode as this is the simplest approach from a control perspective. However, this results in many ions striking the rods and sticking to them resulting in contamination and unwanted charging of the rods. However, in accordance with the invention, the quadrupole mass filter 18 is switched to operate with broad mass range transmission, most preferably in a substantially RF only mode, during the injection idle times (i.e. by switching off the DC filter voltage or setting it very low). This guides most of the ions through the sensitive (to contamination) quadrupole towards the relatively insensitive split lens 22 operating as deflection or blocking electrode. Thus, the invention enables the total number of ions striking the rods of the quadrupole to be reduced and, moreover, allows a substantial time to be left to discharge or evaporate or in any other way disperse any charged films of deposited ions. The split lens 22 acting as a blocking device is configured so that ions are not reflected back into the mass filter 18 when it is blocking the ion beam. The split lens 22 is also configured such that blocked ions strike an electrode of the split lens on the downstream side of the split lens. However, the deposition of ions on that electrode surface and/or charging of that surface do not influence the ion beam.

By actively switching the quadrupole to an RF only (or Full MS) operation mode during idle times between injection, the contamination could be reduced by at least a factor of 2, resulting in longer cleaning intervals. This RF only mode also has the advantage that it does not depend on other ion optical elements. Thus, the RF only mode is easier to implement than other techniques for reducing contamination and allows the spectrometer to be used in continuous mode.

It has been found that charging of the quadrupole mass filter strongly depends on the nature of the deposited ions. Larger ions (e.g. large proteins or peptides) typically contaminate the quadrupole rods much faster than smaller ions, especially if they hit the rods at low energies (so-called soft landing). Soft landing takes place for ions with (m/z) above the selected $(m/z)_0$, while ions with $(m/z)<(m/z)_0$ hit rods with much higher energies comparable with RF amplitude. Therefore, the latter tend to induce sputtering and thus reduced deposition while the former are thought to form porous dielectric layers. Due to their thickness, the charged outer surface of such layers is too far from the underlying metal surface of the rod to be effectively discharged, e.g. by tunnelling electrons and therefore it can charge up to a much higher voltage and ultimately distort operation of the mass filter to an unacceptable level. The present invention may achieve reduction of charging in two ways:

1. the deposition of ions onto the rods is reduced, thus making any deposited layers thinner;
2. additional time is given to discharge any charged layer, thus reducing the voltage perturbation caused by the layer.

It has been found that a non-linear interaction between these effects results in an increase to the interval between required services far greater than the reduction of the duty cycle of deposition.

Typically, a conventional cleaning interval (between required cleans) is years or even never, which is usually the case for small molecule applications. On the other hand, under the conditions of some extreme applications, in certain proteomics cases for example, employing a narrow isolation range of precursor ions and when whole proteome digests are analysed with very high loads on nano-LC columns (e.g. higher than 1 μg), a charging effect may be visible after several months, which requires cleaning. However, using the present invention the cleaning interval may be extended by a factor of 2 or more. As a very worst case example of short cleaning intervals to illustrate the invention, in a TopN method (i.e. a Full MS scan followed by N data-dependent MS/MS scans), using the conventional approach with the apparatus described, the quadrupole could get contaminated within 5-7 days of operation with intense $TiO_2$ enriched phosphopeptide samples with sample concentration above 2 μg resulting in a sensitivity loss. When applying an RF only operation mode in accordance with the invention, a sensitivity loss for the same sample occurred only after more than 23 days. Thus, by the present invention the typical cleaning cycle of the quadrupole could be extended by a factor of more than 2 for this sample.

As used herein, including in the claims, unless the context indicates otherwise, singular forms of the terms herein are to be construed as including the plural form and vice versa.

Throughout the description and claims of this specification, the words "comprise", "including", "having" and "contain" and variations of the words, for example "comprising" and "comprises" etc, mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

Any steps described in this specification may be performed in any order or simultaneously unless stated or the context requires otherwise.

All of the features disclosed in this specification may be combined in any combination, except combinations where at least some of such features and/or steps are mutually exclusive. In particular, the preferred features of the invention are applicable to all aspects of the invention and may be used in any combination. Likewise, features described in non-essential combinations may be used separately (not in combination).

The invention claimed is:

1. A method of mass spectrometry comprising:

transmitting ions from an ion source through a mass filter;

providing a discontinuous ion optical device downstream of the mass filter for processing ions received from the mass filter wherein the processing comprises discontinuously transmitting ions;

operating the mass filter for a plurality of periods in a mass/charge ratio (m/z) filtering mode to transmit ions in one or more selected ranges of m/z to the discontinuous ion optical device; and analysing ions in a mass analyser downstream of the discontinuous ion optical device that have been processed by the discontinuous ion optical device, wherein a duration of processing ions with the discontinuous ion optical device is exceeded by a duration of analysing ions in a downstream mass analyser, wherein a plurality of idle times are defined between periods in which the discontinuous ion optical device is processing ions; and operating the mass filter in a broad mass range mode transmitting ions of a mass range substantially wider than any mass range transmitted in the m/z filtering mode during the idle times, whereby during the idle times ion deposition on surfaces of the mass filter is reduced compared to during the periods when the mass filter is operated in the mass/charge ratio (m/z) filtering mode.

2. A method as claimed in claim 1, wherein the broad mass range mode is a substantially non-m/z filtering mode.

3. A method as claimed in claim 1, comprising switching the mass filter at least once between transmitting different m/z ranges wherein, in order to reduce charging of one or more surfaces of the mass filter, the switching includes a time interval during which the mass filter is operated in the substantially non-filtering mode.

4. A method as claimed in claim 3, comprising switching the mass filter a plurality of times between transmitting different m/z ranges wherein, in order to reduce charging of one or more surfaces of the mass filter, each switching includes a time interval during which the mass filter is operated in the substantially non-filtering mode.

5. A method as claimed in claim 1, wherein in substantially all idle times the mass filter is operated in the broad mass range mode.

6. A method as claimed in claim 1, wherein the broad mass range mode is a substantially RF-only mode wherein electrodes of the mass filter are supplied with substantially only RF voltage.

7. A method as claimed in claim 6, wherein a DC/RF voltage ratio is not greater than 0.06.

8. A method as claimed in claim 1, wherein the duration of the periods of operating in the broad mass range mode on average exceed at least 1% of the duration of the periods operating in the filtering mode.

9. A method as claimed in claim 1, wherein the mass filter is a multipole mass filter, preferably a quadrupole a mass filter.

10. A method as claimed in claim 1, wherein the transmission of ions though the mass filter is continuous.

11. A method as claimed in claim 1, wherein the discontinuous ion optical device is a pulsed ion optical device.

12. A method as claimed in claim 1, wherein the discontinuous ion optical device is an ion trap, or ion deflector, or an orthogonal accelerator.

13. A method as claimed in claim 12, wherein the discontinuous ion optical device is a linear ion trap, preferably a curved linear ion trap (C-trap).

14. A method as claimed in claim 1, wherein the mass analyser is one of: a Fourier Transform (FTMS) mass analyser, an FT-ICR mass analyser, an electrostatic orbital trap mass analyser, a TOF mass analyser, an ion trap mass analyser and a dynamically operating quadrupolar mass analyser.

15. A mass spectrometer comprising:

an ion source for producing ions;

a mass filter for transmitting ions from the ion source;

a discontinuous ion optical device downstream of the mass filter for processing ions received from the mass filter, wherein the processing comprises discontinuously transmitting ions;

a mass analyser downstream of the discontinuous ion optical device for mass analysing ions that have been processed by the discontinuous ion optical device, wherein a duration of processing ions with the discontinuous ion optical device is exceeded by a duration of analysing ions in the mass analyser, wherein a plurality of idle times are defined between periods in which the discontinuous ion optical device is processing ions; and, a controller arranged to operate the mass filter for a plurality of periods in a mass/charge ratio (m/z) filtering mode to transmit ions in one or more selected ranges of m/z to the discontinuous ion optical device and to operate the mass filter in a broad mass range mode transmitting ions of a mass range substantially wider than any mass range transmitted in the m/z filtering mode during the idle times, whereby during idle times ion deposition on surfaces of the mass filter is reduced compared to during periods when the mass filter is operated in the mass/charge ratio (m/z) filtering mode.

16. A method of mass spectrometry comprising:

transmitting ions from an ion source through a first mass filter and subsequently through a second mass filter;

providing a discontinuous ion optical device downstream of the second mass filter for processing ions received from the second mass filter;

operating at least one of the mass filters for a plurality of periods in a mass/charge ratio (m/z) filtering mode to transmit ions in one or more selected ranges of m/z to the discontinuous ion optical device;

analysing ions in a mass analyser downstream of the discontinuous ion optical device that have been processed by the discontinuous ion optical device, wherein a duration of processing ions with the discontinuous ion optical device is exceeded by a duration of analysing ions in the downstream mass analyser, wherein a plurality of idle times are defined between periods in which the discontinuous ion optical device is processing ions; and, operating the mass filter in a broad mass range mode transmitting ions of a mass range substantially wider than any mass range transmitted in the m/z filtering mode during the idle times, whereby during the idle times ion deposition on surfaces of the mass filter is reduced compared to during the periods when the mass filter is operated in the mass/charge ratio (m/z) filtering mode.

17. A method of mass spectrometry comprising:

transmitting ions from an ion source through a mass filter;

providing a mass analyzer downstream of the mass filter for processing ions received from the mass filter;

operating the mass filter for a plurality of periods in a mass/charge ratio (m/z) filtering mode to transmit ions in one or more selected ranges of m/z to the mass analyzer;

analysing ions in the mass analyser downstream of the discontinuous ion optical device that have been processed by the discontinuous ion optical device, wherein a duration of processing ions with the discontinuous ion optical device is exceeded by a duration of analysing ions in the downstream mass analyser, wherein a plurality of idle times are defined between periods in which the discontinuous ion optical device is processing ions; and operating the mass filter in a broad mass range mode transmitting ions of a mass range substantially wider than any mass range transmitted in the m/z filtering mode during the idle times, whereby during the idle times ion deposition on surfaces of the mass filter is reduced compared to during the periods when the mass filter is operated in the mass/charge ratio (m/z) filtering mode.

* * * * *